United States Patent [19]

Landry

[11] Patent Number: 4,979,578

[45] Date of Patent: Dec. 25, 1990

[54] LEVER-ACTION MOTORIZED EARTH DRILL

[76] Inventor: Ronnie J. Landry, 105 Carla Ct., Morgan City, La. 70380

[21] Appl. No.: 484,481

[22] Filed: Feb. 26, 1990

Related U.S. Application Data

[63] Continuation-in-part of Ser. No. 313,068, Feb. 21, 1989, abandoned.

[51] Int. Cl.[5] ..... E21B 7/00; E21B 19/08

[52] U.S. Cl. ..... 175/162; 175/170; 175/203; 173/22; 173/170; 280/47.24

[58] Field of Search ..... 175/162, 202, 203, 87, 175/113, 121, 122, 170; 173/18, 22, 29, 30, 170; 28/47.24; 254/30, 120, 131

[56] References Cited

U.S. PATENT DOCUMENTS

| | | | |
|---|---|---|---|
| 2,499,458 | 3/1950 | Campbell | 280/47.24 |
| 2,505,331 | 4/1950 | Lambly et al. | 280/47.24 |
| 2,604,304 | 7/1952 | Wilson | 173/170 |
| 2,815,049 | 12/1957 | Herscovitch | 173/22 |
| 2,856,156 | 10/1958 | Young | 175/170 |
| 3,913,762 | 10/1975 | Alexander | 214/506 |
| 3,976,147 | 8/1976 | Cunningham | 175/170 |
| 4,271,919 | 6/1981 | Vaughan | 173/22 |
| 4,750,711 | 6/1988 | Landry | 254/30 |

OTHER PUBLICATIONS

"Flyer" Published by Little Beaver, Inc., Entitled Tonque-Free One Man Earth Drilling.

"Flyer" Published by Ground Hog Inc., Entitled Earth Drill D-5.

"Flyer" Published by Ground Hog Inc., Entitled One Man Earth Drill.

*Primary Examiner*—Bruce M. Kisliuk

*Attorney, Agent, or Firm*—Reginald F. Roberts, Jr.

[57] ABSTRACT

Apparatus for digging post holes with motorized power. The earth drill comprises a rigid lever pivotally mounted on an axle supported by a pair of wheels. Motorized digging means are pivotally connected to one end of the lever. The other end of the lever is adapted for exertion of upward and downward forces thereupon. The distance from the point of support of the lever by the axle to the first end of the lever defines a first lever arm. The distance from the point of support to the other end of the lever defines a second lever arm.

32 Claims, 7 Drawing Sheets

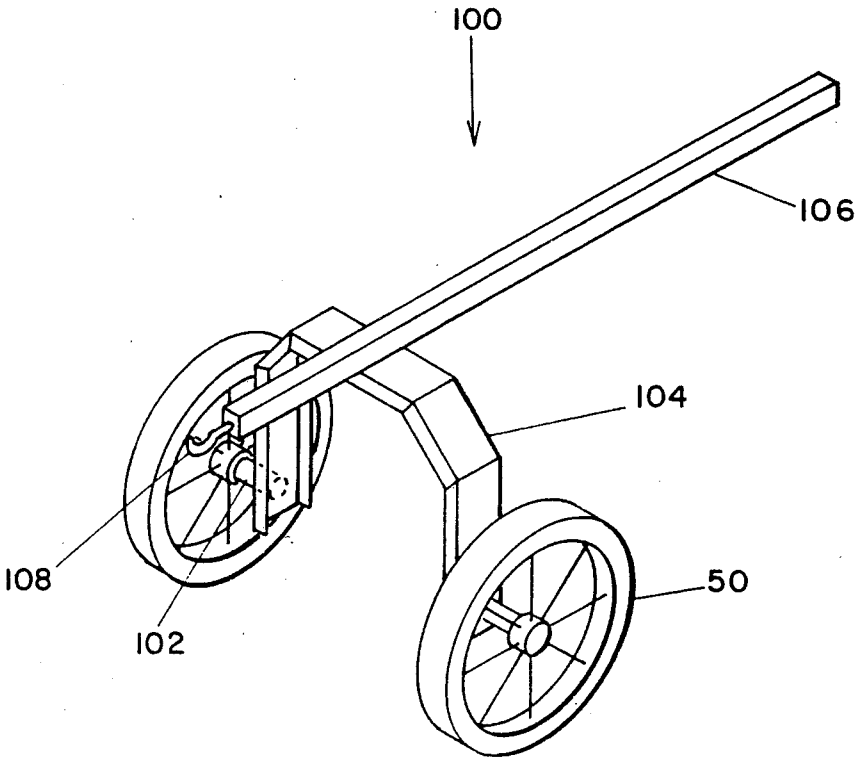
PRIOR ART FIG. 12

LEVER-ACTION MOTORIZED EARTH DRILL

This is a continuation-in-part of application Ser. No. 313,068 filed Feb. 21, 1989, now abandoned.

BACKGROUND OF THE INVENTION

The present invention relates to a digging machine. More particularly, the invention relates to a machine for digging holes in the soil.

In state-of-the-art earth-drilling equipment, a handle to be used by an operator is disposed immediately above the auger or drill which is motor-driven into the ground. This arrangement creates two serious problems. First, there is a safety hazard inherent in the proximity of the operator to the power drill. Second, there is no mechanical advantage to lessen the force which the operator must exert to drive the auger or drill into the ground. Both problems become increasingly serious as the hardness of the soil and the depth of the hole increase.

SUMMARY OF THE INVENTION

In general, the present invention in one aspect provides a machine for digging holes in the sole especially for the disposition of fence posts therein. A post-hole digger made in accordance with the principles of the present invention comprises a rigid lever pivotally mounted on an axle supported by a pair of wheels. Motorized digging means are pivotally connected to a first end of the lever. The second end of the lever is adapted for exertion of upward and downward forces thereupon. The distance from the point of support of the lever by the axle to the first end of the lever defines a first lever arm. The distance from the point of support to the second end of the lever defines a second lever arm.

In a second aspect, the invention provides a frame for a motorized earth druill, comprising: (a) a first rigid triangular member comprising first, second, and third sides, and first, second, and third vertexes opposite the first, second, and third sides, respectively; and (b) a second rigid triangular member comprising first, second, and third sides, and first, second, and third vertexes opposite the first, second, and third sides, respectively. A hinge connects the first vertex of the second triangular member to the first side of the first triangular member. A pedal is connected to the second vertex of the second triangular member. Means are provided for locking the third side of the second triangular member to the first side of the first triangular member in a parallel configuration.

As used herein, the expressions "perpendicular" and "perpendicularly" are defined to mean "substantially perpendicular" and "in a substantially perpendicular configuration"; the expression "parallel" is defined to mean "substantially parallel"; the expression "near" is defined to mean "at or within a close distance of"; "T-shaped" is defined to mean "a shape comprising first and second substantially straight members connected to one another in a substantially perpendicular configuration in which one of the members is joined to the other member at a point which is closer to the mid-point of the other member than to either end of the other member"; and "L-shaped" is defined to mean "a shape comprising first and second substantially straight members connected to one another in a substantially perpendicular configuration in which one of the members is joined to the other member at a point which is closer to one of the ends of the other member than to the midpoint of the other member".

BRIEF DESCRIPTION OF THE DRAWINGS

FIG. 12 is a schematic representation of a prior art device known as a grasshopper.

DETAILED DESCRIPTION OF THE INVENTION

Figure 1:
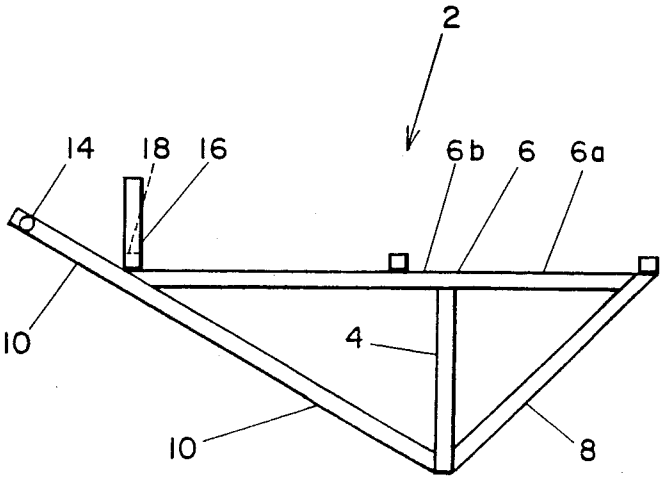
FIG. 1 is a schematic representation of a first embodiment of a single-lever frame for a motorized earth drill, made in accordance with the principles of the present invention, as viewed from the side.
Figure 2:
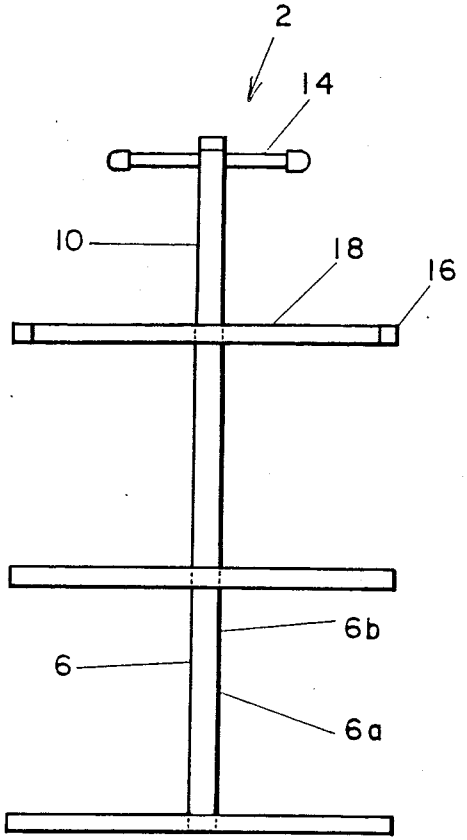
FIG. 2 is a schematic representation of the frame shown in FIG. 1, as viewed from above.

More specifically, reference is made to FIGS. 1 and 2, wherein is shown a first embodiment of a single-lever frame for motorized earth drill, made in accordance with the principles of the present invention, and generally designated by the numeral 2.

The frame 2 comprises a generally T-shaped member which includes a first elongated rigid member 4 connected at one end to a second elongated rigid member 6 in a substantially perpendicular configuration. The elongated members 4 and 6 are preferably straight members.

The frame 2 is beneficially braced by connecting third and fourth elongated rigid members 8 and 10 to the ends of the elongated member 6 and to the other end of elongated member 4. Preferably, the junction of members 4 and 6 is closer to the junction of members 6 and 8 than to the junction of members 6 and 10, defining first end and second lever arms 6*a* and 6*b*, respectively. The reason for this preferences is that it provides a greater mechanical advantage when motorized digging means are connected to the frame 2.

Thus, the ratio of the second to the firsst lever arm is preferably at least 1:1. Even more preferably, this ratio is from about 1:1 to about 10:1. Most preferably, the ratio of the second lever arm 6*b* to the first lever arm 6*a* is from about 2:1 to about 3:1.

The member 10 beneficially extends beyond its junction with the member 6, thereby providing an extension for mounting a handle 14 thereon.

A plurality of transverse rigid horizontal member 18 are fastened to the member 6. The horizontal member 18 nearest the handle 14 is beneficially provided with a short vertical member 16 at or near each end of the horizontal member 18. The horizontal members 18 and vertical members 16 are very useful for carrying fence posts on the top of the frame 2.

Figure 3:
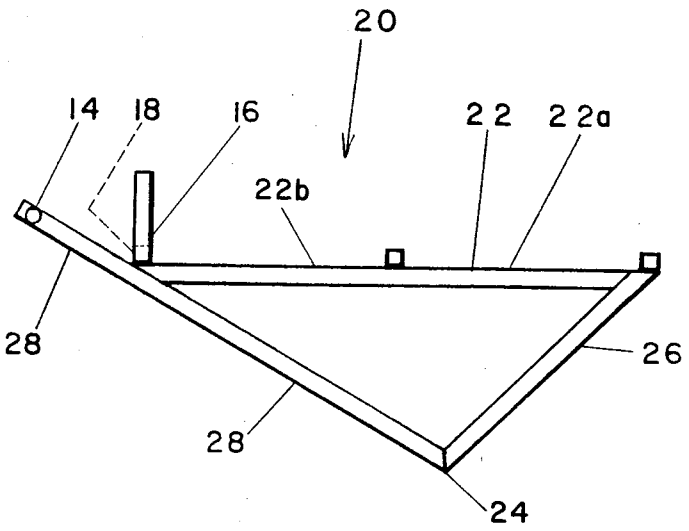
FIG. 3 is a schematic representation of a second embodiment of a single-lever frame for a motorized earth drill, made in accordance with the principles of the present invention, as viewed from the side.

Reference is now made to FIG. 3, wherein is shown a second embodiment of a single-lever frame for a motorized earth drill, made in accordance with the principles of the present invention, and designated generally as 20.

The frame 20 comprises a triangular member which includes first, second, and third sides formed by fifth, sixth, and seventh elongated rigid members 22, 26, and 28, respectively. The vertex 24 of the triangular member opposite the fifth elongated member 22 defines first and second lever arms 22*a* and 22*b*, and is used to mount the frame 20 on an axle (not shown). The elongated members 22, 26, and 28 are preferably straight members.

In order to provide a better mechanical advantage, the first lever arm is made shorter than the second lever arm, the ratio of the second to the first lever arm being from about one:one to about ten:one, and preferably from about two:one to about three:one.

Transverse rigid horizontal members 18 are fastened transversely to the fifth elongated member 22 in a manner entirely analogous to that described for their attachment to the second elongated member 6 of the first frame 2. The horizontal member 18 nearest the handle 14 is beneficially provided with a short vertical member 16 at or near each end of the horizontal member 18. The L-shaped members 16, 18 serve the same purpose and perform the same function as that previously identified in reference to the first embodiment of a single-lever frame 2.

Figure 4:
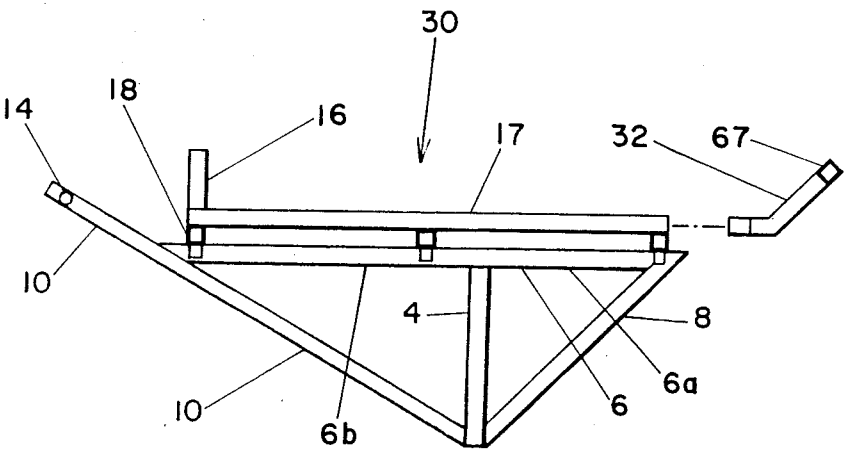
FIG. 4 is a schematic representation of a third embodiment of a single-lever frame for a motorized earth drill made in accordance with the principles of the present invention, as viewed from the side.
Figure 5:
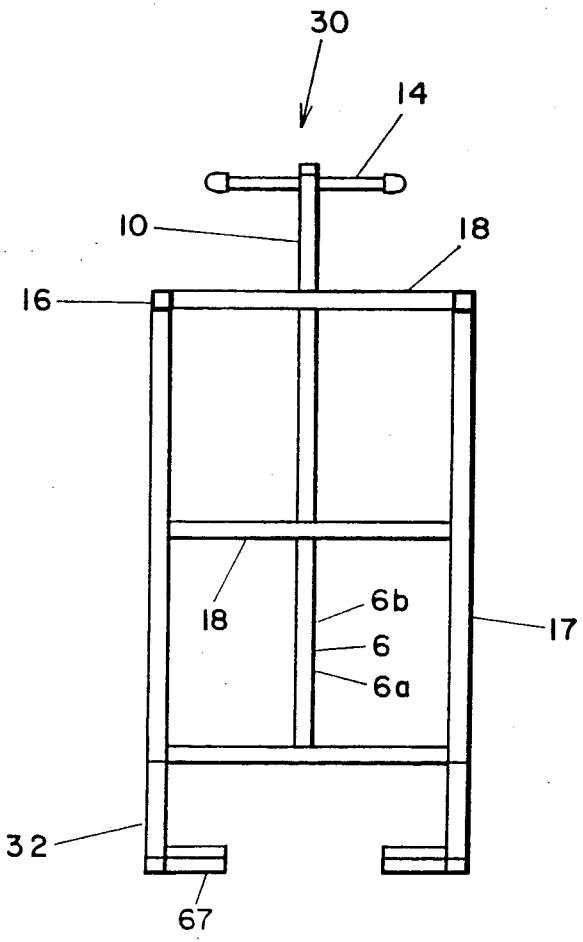
FIG. 5 is a schematic representation of the frame shown in FIG. 4, as viewed from above.

Referring now to FIGS. 4 and 5, a third embodiment of a single-lever frame 30 for a motorized earth drill made in accordance with the present invention comprises the first, second, third and fourth elongated members 4, 6, 8, and 10 utilized in the first embodiment thereof as shown in FIGS. 1 and 2. The frame 30 also includes the L-shaped transverse members comprising in combination the members 16 and 18. Additionally, the frame 30 comprises fifth and sixth elongated rigid members 17. The members 17 are substantially parallel to the member 6, and are connected thereto and to one another by a plurality of substantially horizontal transverse cross-members 18. At one end each elongated member 17 is fastened to a rigid oblique member 32 provided with a sleeve 67 for disposing therein means for pivotally connecting the members 32 to a motor and auger (not shown).

Figure 6:
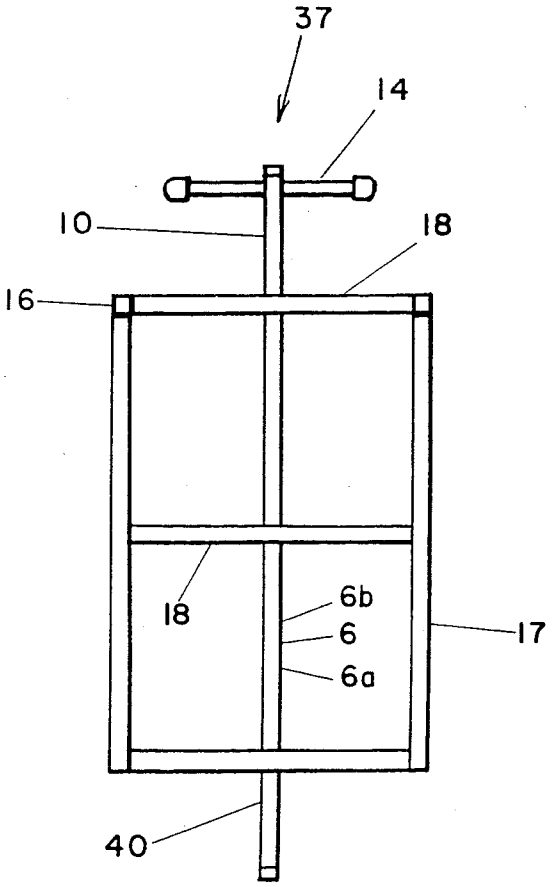
FIG. 6 is a schematic representation of a fourth embodiment of a single-lever frame for a motorized earth drill made in accordance with the principles of the present invention, as viewed from above.

A fourth embodiment 37 of a single-lever frame for a motorized earth drill constructed in accordance with the present invention, shown in FIG. 6, is identical with that of the third embodiment 30, except that the oblique members 32 are replaced by a central rigid oblique member 40, connected to the elongated member 6, and providing means for pivotally connecting a motor-driven auger (not shown) to the frame 37.

Figure 7:
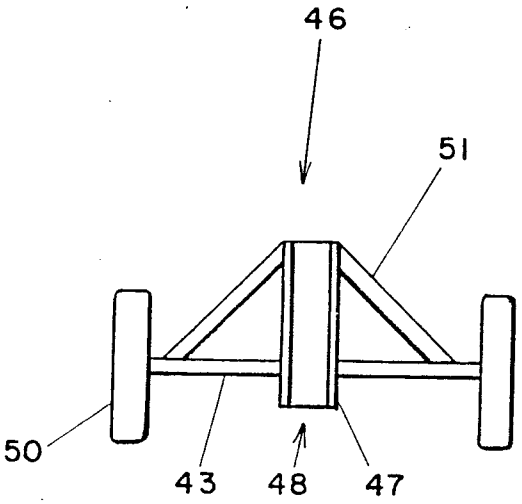
FIG. 7 is a schematic representation of an axle-and-wheel assembl for pivotally mounting the frames shown in FIGS. 1–6, made in accordance with the principles of the present invention, as viewed from the front.

The frames 2, 20, 30, and 37 are each mounted on an axle-and-wheel assembly 46 shown in FIG. 7. The frame is mounted on an axle 48, which includes a pair of shafts 43 linked by a shaft-connector 47, and which is braced by a pair of trusses 51. The axle 48 is supported by a pair of wheels 50. The frame then acts and serves as a lever, and the axle as a fulcrum.

The frames 2, 20, 30, and 37 are mounted on the axle 48 by fastening the frame to the shaft-connector 47. The frames are mounted by disposing the lower part of the frame within the shaft-connector 47, which is hollow. The lower part of each frame is then bolted or otherwise fastened to the sides of the shaft-connector 47.

The radius of the wheel 50 is preferably somewhat less than the length of the first elongated member 4, and is approximately equal to the shortest distance from the vertex 24 to the elongated member 22. These relative dimensions provide maximum mechanical advantage for the frame 2, 20, 30, and 37 when used in combination with a motor and auger to dig post holes.

Even more preferably, the ratios of the lengths of the members 4, 6, 10, and 8 to the radius of the wheel 50 are about one and one-half, four and one-half, three, and two to one, respectively.

Most preferably, the lengths of the members 4, 6, 10, and 8 are approximately ninteen, fifty-eight, forty, and twenty-eight inchess, respectively; and the radius of the wheel 20 is about thirteen inches. These dimensions have been found to optimize the performance of a post-hole digger made in accordance with the priniciples of the present invention.

The member 4, 6, 8, 10, 16, 17, and 18 are preferably made of L-shaped angle iron or hollow tubing. More preferably, they are made of hollow tubing. Even more preferably, they are made of square tubing, since square tubing has the advantagess of ease of fabrication, ease of assembly, versatility, and structural strength. Most preferably, they are made of square metallic tubing, for maximum strength.

It is of course possible to make a earth drill in accordance with the principles of the present invention by simply mounting a single rigid elongated member pivotally on an axle supported by a pair of wheels. Such an arrangement would, however, not be the best way of utilizing the basic concept of the present invention, since the single rigid elongated member would be subject to very considerable torque by the forces acting on both ends of the member. These forces would cause all but the sturdiest and heaviest of rigid elongated members to bow and lose their straight-line geometry.

The frames disclosed hereinabove, and the double-lever frame to be disclosed hereinafter, provide an improvement over such a simplistic arrangement in at least two ways. (1) They provide a studier reinforced support for the rigid elongated member; and (2) they provide a variable mechanical advantage, a concept fully disclosed by U.S. Pat. No. 4,750,711 to Landry, which is incorporated by reference.

Figure 8:
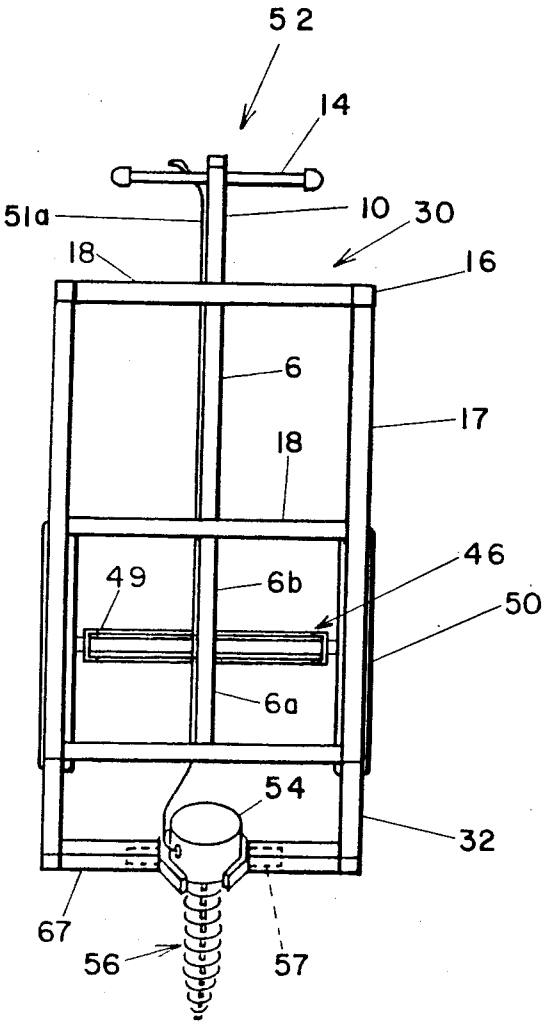
FIG. 8 is a schematic representation of a motor and auger mounted on the third embodiment of a frame for a motorized earth drill, made in accordance with the principles of the present invention, as viewed from above.

Reference is now made to FIG. 8, which shows a first embodiment of a motorized earth drill, generally designated by the numeral 52, made in accordance with the principles of the present invention.

The earth drill 52 comprises a frame 30 pivotally mounted on an axle-and-wheel assembly 46, the frame 30 and the axle-wheel assembly 46 being shown individually in FIGS. 5 and 7, respectively, and having described hereinabove with reference thereto.

Optionally an axle (shown in FIG. 9 at 45) comprising a single shaft journalled in the first elongated member 4 near the junction thereof with the third and fourth members 8 and 10 may be substituted for the axle 48 shown in FIG. 7. If this option is chosen, the axle 45 should be further braced by a generally U-shaped member 49, shown in FIG. 9 at 49. It is not, however, necessary to use the U-shaped member 49 with the axle 48. Preferably, the axle 48 is used in combination with the frame 30, shown in FIG. 4, and 70, shown in FIG. 11, as well as with the frames 2 and 37.

A motor 54 and an auger 56 connected thereto are mounted on the frame 30 pivotally fastening the motor 54 to the oblique member 32. This is readily accomplished with a pair of shafts 57 disposed in sleeves 67 and fastened to the casing or housing of the motor 54 by brackets or mechanical jaws 58. One end of each sleeve 67 is fastened to one of the oblique members 32, and may be integral therewith. The motor 54 drives the auger 26, the speed of the motor being regulated and controlled by a throttle-control linkage 51*a*.

Figure 9:
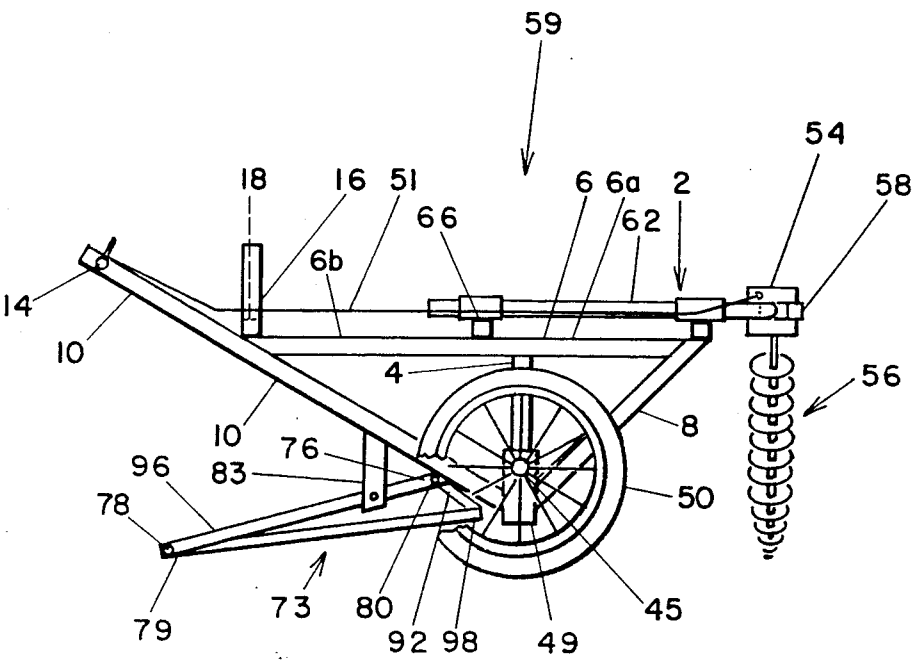
FIG. 9 is a schematic representation of a motor and an auger mounted on a double-lever frame for a motorized earth drill, made in accordance with the principles of the present invention, as viewed from the side.

FIG. 9 shows a second embodiment, designated generally at 59, of a motorized earth drill made in accordance with the principles of the present invention.

The earth drill 59 comprises a motor 54 and an auger 56 mounted on the first embodiment of a single-lever frame, designated generally at 2 in FIG. 1. The frame 2 is mounted on an axle comprising a single shaft 45, braced by the U-shaped membe 49.

The motor 54 drives the auger 56, the speed of the motor 54 being regulated and controlled by the throttle-control linkage 51a. As in the first embodiment of the earth drill 52, the degree of inclination of the auger 56 is manually controlled with the handle 14.

Figure 10:
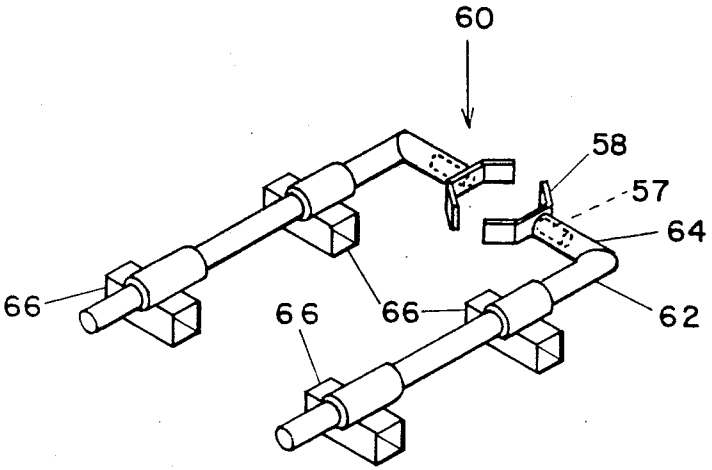
FIG. 10 is a schematic representation of an attachment for mounting a motor and an auger on the first embodiment of a single-lever frame or on a double-lever frame for a motorized earth drill, made in accordance with the principles of the present invention, as viewed from above.

The motor 54 and auger 56 are fastened to the frame 2 by means of an attachment 60 shown in FIG. 10. The attachment 60 comprises a pair of parallel rigid members 62, each of which is joined to one end of a cross-sleeve 64. The other end of each member 64 is pivotally connected to a bracket 58 by a shaft 57. The brackets 58 provide support for the motor 54. The brackets 58 provide support for the motor 54. The shaft 57 pivots in the sleeve 64. One end of each member 18 is disposed in a sleeve 66, and is rigidly fastened thereto by set screws (not shown). The sleeves 64 are preferably made of hollow tubing. More preferably, they are made from square metallic tubing, as explained hereinabove for the members 4, 6, 8, 10, 16, 17, and 18.

A slightly different embodiment of a motorized earth drill mounted on the frame 2 is disclosed in U.S. Pat. No. 4,750,711 to Landry in FIG. 12. The attachment device for attaching the motor and auger to the frame 2 is shown in the patent to Landry in FIG. 16.

Optionally, the motor 54 and auger 56 can be fastened to the frame 2 by first and second substantially J-shaped rigid members (not shown). The J-shaped members comprise the oblique member 40 shown in FIG. 6, an elongated rigid member fastened perpendicularly to the oblique member 40 and extending outward therefrom, and a substantially semicircular sleeve. The motor 54 is pivotally joined to the J-shaped members by the shafts 57 shown in FIG. 8. The shaft 57 is disposed in the sleeve of the J-shaped member, in which it freely rotates. The same mechanism can be used to connect the motor 54 to the end 6*a* of the frame 37 shown in FIG. 6.

The single-lever frame 2 may be converted into a double-lever frame by fastening to the elongated member 10 a second triangular member 73. The elongated member 10 is connected to the second triangular member 73 by a hinge 80. The elongated member 10 is also connected to the second triangular member 73 by a lock 83. One vertex 79 of the second triangular member 73 is connected to a pedal, designated by the numeral 78. The second triangular member 73 is preferably fabricated of L-shaped angle iron or hollow tubing. More preferably it is fabricated of hollow tubing. Even more preferably, it is made of square tubing. Most preferably it is made of square metallic tubing, as explained hereinabove for the members 4, 6, 8, 10, 16, 17, and 18.

Figure 11:
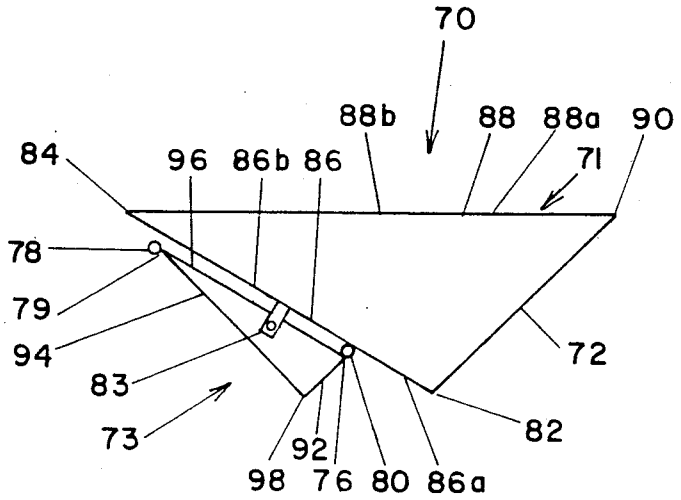
FIG. 11 is a schematic representation of a double-lever frame for a motorized earth drill, made in accordance with the principles of the present invention, as viewed from the side.

The operation and function of the second triangular member 73 is best understood by reference to FIG. 11, which shows a schematic diagram of a double-lever frame, generally designated by the numeral 70. The double-lever frame 70 comprises a first rigid triangular member 71 and a second rigid triangular member 73. The second triangular member 73 is pivotally connected to a side 86 of the first triangular member 71 by the hinge 80, at a vertex 76 of the second triangular member 73. A lock 83 connects one side of the second triangular member 73 with the side 86 of the first triangular member 71.

The first triangular member 71 first, second, and third sides 86, 88, and 72, respectively; and first, second, and third vertexes 90, 82, and 84, respectively. The second triangular member 73 comprises first, second, and third sides 94, 92, and 96, respectively; and first, second, and third vertexes 76, 79, and 98, respectively. The sides 86, 88, and 72 of the first triangular member 71, and the sidess 94, 92, and 96 of the second triangular member 73 are preferably formed from L-shaped angle iron or hollow tubing. Even more preferably, they are formed of hollow tubing. Most preferably they are made from square metallic tubing, as explained hereinabove for the members 4, 6, 8, 10, 16, 17, and 18.

The distance along the side 88 of the first triangular member 71 from the vertex 90 to a point directly opposite the vertex 82 defines a first lever arm 88*a*. The distance along the side 88 from the vertex 84 to the point opposite the vertex 82 defines a second lever arm 88*b*.

The side 72 of the first triangular member defines a third lever arm. The distance along the side 86 from the vertex 84 to a point directly opposite the pedal 78 defines a fourth lever arm.

The distance along the side 86 from the vertex 82 to the point of attachment of the hinge 80 is designated 86*a*, and the distance along the side 86 from the vertex 84 to the point of attachment of the hinge 80 is designated 86*b*.

The ratio of the second lever arm 88*b* to the first lever arm 88*a* is from about 1:1 to about 10:1. Preferably this ratio is from about 2:1 to about 3:1.

The ratio of the fourth lever arm to the third lever arm 72 is from about 1:1 to about 10:1, and preferably from about 2:1 to about 3:1.

The ratio of the length 86*b* to the length 86*a* from about 1:1 about 10:1, and preferably from about 2:1 to about 3:1.

When the motorized earth drill is in the position shown in FIG. 9, the second triangular member 73 is displaced from the first triangular member comprising the members 6, 8, and 10 in FIG. 9. As the auger 56 digs into the ground, the member 6 assumes an angle with the horizontal, and the side 92 of the second triangular member 73 moves toward the elongated member 10, eventually becoming parallel therewith. When the member 6 is in this position, i.e., defining an acute angle with a horizontal plane, the mechanical advantage of the lever defined by the member 6 and the frame 2 is considerably less than when the member 6 is in the horizontal position shown in FIG. 9. At this point it therebefore becomes desirable and beneficial to bring into play a second lever comprising third and fourth lever arms defined by the member 8 and part of the member 10, respectively. This is done operating the foot pedal 78.

The lock 83 is used manually, to lock the second triangular member 73 to the first triangular member. Any of the configurations which the triangular members assume can be locked into place, using bolt means included in the lock 83. The second triangular member 73 can therefore be locked into any desired configuration by the lock 83, thereby stabilizing the configuration by the lock 83, thereby stabilizing the configuration until the lock 83 is released.

The second triangular member 73 and pedal 78 can be used to convert any of the other embodiments of the frame and of the post-hole digger from single-lever to double-lever devices.

While the double-lever frame has been described for use with axle and wheels for making a earth drill, it will be clear to one skilled in the art that is equally useful for making a carrying cart. Such usage is considered and declared to be within the scope of the present claimed invention. The patent to Landry, which has been incorporated by reference, fully discloses a post puller and means for attaching motorized digging means thereto for constructing a post-hole digger. The single-lever frames disclosed by Landry can be made double-lever frames by combining them with the second triangular member 73, pedal 78, and lock 83 herein disclosed.

When used with a post-puller, the second triangular member 73 is preferably kept in the closed, locked position shown in FIG. 11. When used with a carrying cart, the preferred configuration would be that shown in FIG. 9. With the carrying cart, the second triangular member 73 is preferably locked into the configuration shown in FIG. 9, thereby stabilizing and providing a stand for the cart.

A third embodiment (not shown) of a motorized earth drill digger made in accordance with the principles of the present invention comprises a motorized auger 56 pivotally connected to one end of the frame 20, which is pivotally mounted on the wheel-and-axle assembly 46.

Pivotal mobility in a vertical plane of frame and auger is critical to the utility of all embodiments of the present invention. Pivotally mobility of the frame is achieved by pivotally mounting the frame on the axle 48 or the axle 45. Bearings (not shown) may be used to mount the frame on the axle, as well as to mount the axle on the wheels 50. Pivotal mobility of the motorized auger 56 is achieved by pivotal attachment attachment of the motor 54 to the frame through the sleeves 64 or 67.

Reference is now made Fig. 12, in which is shown a prior-art device known as a "grasshopper, " and designated generally by the numeral 100. The grasshopper 100 is generally used to carry metal pipe and similar materials. It utilizes a pair of wheels 50 similar to those employed by the present invention. One end of a shaft 102 is disposed in each of the wheels 50, to serve as an axle. A rigid transverse member 104 is mounted on and disposed above the shafts 102, and is pivotally fastened to the other ends of the shafts 102. A rigid elongated member 106 is fastened to the transverse member 104 at the approximate midpoint of the transverse member in a substantially perpendicualr configuration. One end of the elongated member 106 is provided with a hook 108, and the pipe or other material to be carried by the grasshopper 100 is slung below and loosely attached to the elongated member 106.

The grasshopper 100 can be modified to make a fourth embodiment of a earth drill in accordance with the principles of the present invention, by replacing the hook 108 with motorized digging means. The elongated member 106 then serves as a lever, and the other end of the member 106 as a handle. The member 106 is preferably made of L-shaped angle iron or hollow tubing. More preferably, it is made of hollow tubing. Even more preferably, it is made of square tubing. Most preferably it is made of square metallic tubing, for the reasons previously stated. The motorized digging means, such as motor 54 and auger 56 shown in FIGS. 8 and 9, are readily connected to the end of the member 106 in the same manner as described hereinabove for their attachment to the frames 2 and 37, using the same substantially 4-shaped rigid members.

Preferably, however, because the frame for the grasshopper is larger than that preferred for motorized earth drills made in accordance with the present invention, the dimensions of the frame are made to conform with those specified hereinabove for the preferred embodiments of the earth drill.

I claim:

1. A motorized earth drill, comprising:

(a) a straight rigid lever pivotally mounted on an axle supported by a pair of wheels; and (b) motorized digging means pivotally connected to a first end of the lever, the second end of the lever adapted for exertion of vertical forces thereupon, the distance from the locus of support of the lever by the axle to the first end of the lever defining a first lever arm, the distance from the locus of support by the axle to the second end of the lever defining a second lever arm, the ratio of the second lever arm to the first lever arm being at least about 1:1.

2. The earth drill of claim 1, wherein the ratio of the second lever arm to the first lever arm is from about 1:1 to about 10:1.

3. The earth drill of claim 1, wherein the ratio of the second lever arm to the first lever arm is from about two:one to about three:one.

4. The earth drill of claim 1, wherein the digging means include a motor-driven auger.

5. The earth drill of claim 1, wherein the lever defines a substantially T-shaped rigid member.

6. The earth drill of claim 5, wherein the T-shaped member includes a first rigid elongated member mounted on the axle, and a second rigid elongated member fastened to one end of the first member in a substantially perpendicular configuration.

7. The earth drill of claim 6, wherein the first and second rigid elongated members are square tubular members.

8. The earth drill of claim 5, wherein the T-shaped member includes a first rigid elongated member mounted on the axle, and a second rigid elongated member fastened to one end of the first member in a substantially perpendicular configuration; and the post-hole digger further includes third and fourth rigid elongated members substantially parallel to the second elongated member, the second elongated member disposed between the third and fourth elongated members; and fifth and sixth rigid elongated transverse members connecting the second, third, and fourth elongated members to one another, the fifth elongated member connecting the second, third, and fourth elongated members to one another near one end of the second, third, and fourth elongated members, the sixth elongated member connecting the second, third, and fourth elongated members to one another near the other end of the second, third, and fourth elongated members, the fifth and sixth elongated members substantially perpendicular to the second, third, and fourth elongated members.

9. The earth drill of claim 8, wherein the digging means are connected to one end of the third and fourth rigid elongated members.

10. The earth drill of claim 8, wherein the digging means are connected to one end of the second elongated rigid member.

11. The earth drill of claim 8, wherein the frame further includes a seventh rigid elongated transverse member substantially perpendicular to the second, third, and fourth elongated members, the seventh elongated member connecting the second, third, and fourth elongated members to one another near the midpoint of the second, third, and fourth elongated members.

12. The earth drill of claim 11, wherein the seventh rigid elongated transverse member is made of square tubing.

13. The earth drill of claim 8, wherein the first, second, third, fourth, fifth, and sixth elongated rigid members are square tubular members.

14. The earth drill of claim 5, wherein the rigid T-shaped member is made of square tubing.

15. The earth drill of claim 1, wherein the lever defines a substantially T-shaped rigid member which includes a first rigid elongated member mounted on the axle, and a second rigid elongated member fastened to one end of the first member in a substantially perpendicular configuration; and wherein the post-hole digger further includes a plurality of rigid transverse members fastened perpendicularly to the second elongated member, and the digging means are connected to the rigid transverse members by attachment means fastened to the rigid transverse members.

16. The earth drill of claim 15, wherein the rigid transverse members are square tubes.

17. The earth drill of claim 1, wherein the lever includes a square tubular member.

18. A motorized earth drill, comprising:

(a) a rigid lever pivotally mounted on an axle supported by a pair of wheels; and (b) motorized digging means pivotally connected to a first end of the lever, the second end of the lever being adapted for exertion of vertical forces thereupon, the distance from the locus of support of the lever by the axle to the first end of the lever defining a first lever arm, the distance from the locus of support by the axle to the second end of the lever defining a second lever arm, the lever comprising a substantially triangular rigid member pivotally mounted on the axle at a first vertex of the triangular member, the digging means being connected to the lever at a second vertex of the triangular member.

19. The earth drill of claim 18, wherein the frame further includes a plurality of rigid transverse members fastened perpendicularly to the member forming the side opposite the first vertex of the triangular member; and the digging means are pivotally connected to the frame by attachment means fastened to the rigid transverse members.

20. The earth drill of claim 19, wherein the rigid transverse members are made of square tubing.

21. The earth drill of claim 18, wherein the rigid triangular member is made of square tubing.

22. A motorized earth drill, comprising:

(a) a generally T-shaped member which acts as a lever, the T-shaped member including a first rigid elongated member connected at one end to a second elongated rigid member in a substantially perpendicular configuration, the first elongated member pivotally mounted near the other end of the first elongated member on an axle supported by a pair of wheels;

(b) first bracing means, including third and fourth elongated rigid members, first ends of the third and fourth elongated members connected to the other end of the first elongated member, the second end of the third elongated member connected to a first end of the second elongated member, the fourth elongated member to the second end of the first elongated member, the junction of the first and fourth elongated members closer to the junction of the second and third elongated members than to the junction of the second and fourth elongated members, the fourth elongated member extending beyond its junction with the second elongated member to provide an extension for the attachment of a handle;

(c) a handle fastened to the extension of the fourth elongated member, for applying a torque to the fourth elongated member and the T-shaped member;

(d) second bracing means, including a generally U-shaped rigid member, each end of the U-shaped member pivotally mounted on the axle near each wheel; and fastened to the first, third, and fourth elongated members at the junction of the first, third, and fourth elongated members;

(e) fifth and sixth elongated rigid members substantially parallel to the second elongated member, the second elongated member disposed between and spaced apart from the fifth and sixth elongated members, first ends of the fifth and sixth elongated members disposed proximate the handle;

(f) first, second, and third rigid, substantially horizontal transverse members fastened perpendicularly to the second, fifth, and sixth elongated members;

(g) first and second rigid oblique members fastened to the fifth and sixth elongated rigid members near the second end of the fifth and sixth elongated members, to provide support means for pivotally mounting a motor-driven auger; and (h) means for pivotally connecting the motor-driven auger to the rigid oblique members.

23. The earth drill of claim 22, wherein the first, second, third, fourth, fifth, and sixth rigid elongated members, and the first and second rigid oblique members, are made of square tubing.

24. A motorized earth drill, comprising:

(a) a generally T-shaped member which acts as a lever, the T-shaped member including a first rigid elongated member connected at one end to a second elongated rigid member in a substantially perpendicular configuration, the first elongated member pivotally mounted near the other end of the first elongated member on an axle supported by a pair of wheels;

(b) first bracing means, including third and fourth elongated rigid members, first ends of the third and fourth elongated members connected to the other end of the first elongated member, the second end of the third elongated member connected to a first end of the second elongated member, the fourth elongated member to the second end of the first elongated member, the junction of the first and fourth elongated members closer to the junction of the second and third elongated members than to the junction of the second and fourth elongated members, the fourth elongated member extending beyond its junction with the second elongated member to provide an extension for the attachment of a handle;

(c) a handle fastened to the extension of the fourth elongated member, for applying a torque to the fourth elongated member and the T-shaped member;

(d) second bracing means, including a pair of trusses fastened to the axle and to a shaft-connector fastened to the first elongated member, the shaft-connector connecting a pair of shafts supported by the pair of wheels, the trusses obliquely connected to the shafts and to the shaft-connector;

(e) fifth and sixth elongated rigid members substantially parallel to the second elongated member, the second elongated member disposed between and spaced apart from the fifth and sixth elongated members, first ends of the fifth and sixth elongated members disposed proximate the handle;

(f) a first rigid, transverse, substantially horizontal member fastened perpendicularly to the second, fifth, and sixth elongated members near the first ends of the second, fifth, and sixth elongated members;

(g) a second rigid, substantially horizontal transverse member fastened perpendicularly to the second, fifth, and sixth elongated members near the second ends of the second, fifth, and sixth elongated members;

(h) a third rigid, substantially horizontal transverse member fastened perpendicularly to the second, fifth, and sixth elongated members near the midpoint of the second, fifth, and sixth elongated members;

(i) a pair of rigid, substantially vertical members fastened perpendicularly to the ends of the first horizontal transverse member, to provide means for containing a load of fence posts above the second, fifth, and sixth elongated members and the first, second, and third horizontal transverse members;

(j) first and second rigid oblique members fastened to the fifth and sixth elongated rigid members near the second ends of the fifth and sixth elongated members, to provide support means for pivotally mounting a motor-driven auger; and (k) means for pivotally connecting the motor-driven auger to the rigid oblique members.

25. The earth drill of claim 24, wherein the rigid elongated members, the rigid transverse members, and the rigid oblique members are fabricated from square tubing.

26. A frame for a motorized earth drill, comprising:

(a) a first rigid triangular member comprising first, second, and third sides, and first, second, and third vertexes opposite the first, second, and third sides, respectively;

(b) a second rigid triangular member comprising first, second, and third sides opposite first, second, and third vertexes, respectively;

(c) a hinge connecting the first vertex of the second triangular member to the first side of the first triangular member; and (d) a pedal connected to the second vertex of the second triangular member.

27. A motorized earth drill, comprising:

(a) a first rigid triangular member comprising first, second, and third sides opposite first, second, and third vertexes, respectively;

(b) a second rigid triangular member comprising first, second, and third sides opposite first, second, and third vertexes, respectively;

(c) a hinge connecting the first vertex of the second triangular member to the first side of the first triangular member;

(d) a pedal connected to the second vertex of the second triangular member, the first triangular member, the hinge, and the pedal comprising a frame for the motorized post-hole digger, a first end of the frame adapted for connection thereto of motorized digging means, the second end of the frame adapted for exertion thereon of vertical forces to impress a torque on the frame;

(e) means for connecting motorized digging means to the first end of the frame; and (f) motorized digging means connected to the first end of the frame.

28. The motorized earth drill of claim 27, wherein:

(g) the distance along the second side (88) of the first triangular member (71) from the first vertex (90) of the first triangular member (71) to a point directly opposite the second vertex (82) of the first triangular member (71) defines a first lever arm;

(h) the distance along the second side of the first triangular member from the third vertex of the first triangular member to the point directly opposite the second vertex of the first triangular member defines a second lever arm;

(i) the ratio of the second lever arm to the first lever arm is from about 1:1 to about 10:1;

(j) the third side of the first triangular member defines a third lever arm;

(k) the distance along the first side of the first triangular member from the third vertex of the first triangular member to a point directly opposite the pedal defines a fourth lever arm; and (l) the ratio of the fourth lever arm to the third lever arm is from about 1:1 to about 10:1.

29. The earth drill of claim 28, wherein:

(i) the ratio of the second lever arm to the first lever arm is from about 2:1 to about 3:1; and (l) the ratio of the fourth lever arm to the third lever arm is from about 2:1 to about 3:1.

30. The earth drill of claim 27, wherein the first and second triangular members are made from square tubing.

31. A motorized earth drill, comprising:

(a) a pair of wheels;

(b) an end of a shaft disposed in each of the wheels, to serve as an axle;

(c) a rigid transverse member mounted on the shaft and spanning the space between the wheels, the transverse member disposed above and pivotally fastened to the axle;

(d) a rigid elongated member fastened to the transverse member at the approximate midpoint of the transverse member in a substantially perpendicular configuration, to serve as a lever, both ends of the elongated member extending beyond the junction of the elongated member with the transverse member; and (e) motorized digging means pivotally connected to one end of the elongated member.

32. The earth drill of claim 31, wherein the rigid elongated member is made from square tubing.

* * * * *